United States Patent [19]

Ellenberger et al.

[11] 4,000,484

[45] Dec. 28, 1976

[54] DIRECTLY HEATED BIMETALLIC STRIP FOR USE IN A THERMAL TRIP

[75] Inventors: by Horst Ellenberger, Altdorf; by Norbert Ellenberger, Feucht; by Marga Sell nee Ellenberger, heirs, Altdorf, all of Germany; Jakob Philipp Ellenberger, deceased, late of Altdorf, Germany

[73] Assignee: Ellenberger & Poensgen GmbH, Altdorf near Nuernberg, Germany

[22] Filed: Sept. 26, 1975

[21] Appl. No.: 617,169

[30] Foreign Application Priority Data

Oct. 9, 1974 Germany ..... 2448026

[52] U.S. Cl. ..... 337/109; 337/111

[51] Int. Cl.[2] ..... H01H 61/01; H01H 71/16

[58] Field of Search ..... 335/43, 44, 45; 337/109, 375, 379, 111

[56] References Cited

UNITED STATES PATENTS

| | | | |
|---|---|---|---|
| 1,509,965 | 9/1924 | MacFarland | 337/109 X |
| 1,886,354 | 11/1932 | O'Keeffe | 337/109 X |
| 2,289,061 | 7/1942 | Mertler | 337/379 X |
| 2,980,779 | 4/1961 | Hickle et al. | 335/43 X |

FOREIGN PATENTS OR APPLICATIONS

| | | | |
|---|---|---|---|
| 768,268 | 9/1967 | Canada | 335/43 |
| 301,425 | 3/1930 | United Kingdom | 335/43 |

*Primary Examiner*—George Harris
*Attorney, Agent, or Firm*—Spencer & Kaye

[57] ABSTRACT

A directly heatable bimetallic strip which can be disposed to carry the load current through a thermal trip.

The bimetallic strip comprises an elongate member having first and second end portions and an intermediate portion. The intermediate portion comprises three or more odd number of parallel arms extending substantially longitudinally of the strip. The arms are connected in meanderline fashion with one arm connected to the first end portion and another arm connected to the second end portion and the junctions of the arms being spaced from the first and second end portions. Two connecting pieces of an insulating material are provided. One connecting piece rigidly joins together the first end portion, the arm connected thereto and the junction or junctions adjacent to, but spaced from, the first end portion, and the other connecting piece rigidly joins together the second end portion, the arm connected thereto and the junction adjacent to, but spaced from, the second end portion.

The present invention also relates to a thermal trip including the bimetallic strip.

9 Claims, 4 Drawing Figures

DIRECTLY HEATED BIMETALLIC STRIP FOR USE IN A THERMAL TRIP

The invention relates to a directly heatable bimetallic strip suitable for use in a thermal trip device.

Bimetallic strips are known in which one end is fixed and the other end is free and power supply connections are provided both at its fixed end and at its free end. When heated sufficiently the bimetallic strip bends and the free end breaks its power supply connection.

A bimetallic strip of this type which is used for thermally tripping an overcurrent circuit breaker actuated by a pressure head and has, close to its free end, a holding catch which, when the overcurrent circuit breaker is in the on position, engages behind an angle-shaped contact bridge and retains the latter in the on position, is disclosed in U.S. Pat. No. 2,895,028. When the bimetallic strip deflects under overcurrent, the holding catch of the bimetallic strip releases the contact bridge at a certain deflection, so that the bridge is moved into the off position under the action of a pressure spring. For this purpose the holding catch is designed as a contact piece which, in the on position fits on the appropriate end of the contact bridge, so that the circuit within the overcurrent circuit breaker is closed in this way, the holding catch forming the connection for the free end of the bimetallic strip. The lower end of the bimetallic strip has a right-angled bend which is connected to a connection lug so as to give good electrical conduction. The right-angled bend and the connection lug have a threaded bore for taking an adjustable current presetting screw which, with its end shaped in the form of a cone, sits on a right-angled bend of the bimetallic strip. The tripping current of the overcurrent circuit breaker can be set by actuating the adjusting screw. For currents of 8 A and upwards the bimetallic strip usually heats up directly, whereas in the case of nominal currents below 8 A, a heating coil is provided for indirect heating of the bimetallic strip. This heating coil, however, must not be heavily overloaded by the heating current otherwise permanent damage may be caused to the coil. Normally, only the ten-fold value of the heating current can flow through the heating coil without permanent damage.

According to the present invention there is provided a directly heatable bimetallic strip for use in a thermal trip, comprising first and second end portions and an intermediate portion between the first and second end portions, the intermediate portion comprising three or more odd number of parallel, series connected arms extending substantially longitudinally of the bimetallic strip with an end of one of the arms connected to the first end portion, an end of another of the arms connected to the second end portion, a junction or alternate junctions of the arms adjacent to, but spaced from the first end portion and the other junction or other alternate junctions adjacent to, but spaced from, the second end portion, and first and second connecting pieces of an insulating material, the first connecting piece rigidly joining together the first end portion, the one arm, and the junction or junctions adjacent the first end portion and the second connecting piece rigidly joining together the second end portion, the another arm and the other junction or junctions.

The division of the bimetallic strip into three or more odd number of parallel arms results in a large increase in the resistance of the bimetallic strip. Since the arms have a relatively large cross-section, they can take a correspondingly large heating current input, so that a large overload capacity of the bimetallic strip results. The connecting pieces composed of insulating material stiffen the bimetallic strip in accordance with the invention in such a way that its amplitude of deflection corresponds to that of a bimetallic strip not having an intermediate portion comprising an odd number plurality of series connected arms.

A bimetallic strip which is divided up into four parallel arms has already been disclosed in German Patent Specification No. 867,261. In this case, the individual arms, especially the two outer arms, extend from one end of the bimetallic strip to the other. The two inner arms form a U-shaped bimetallic strip which is heated directly and receives the heating current at the ends of the two arms. The two outer arms of the bimetallic strip are not heated by current but only by ambient heat, so that these two outer arms merely serve to compensate for the ambient temperature.

Furthermore, a bimetallic strip which also is divided up into four parallel arms is disclosed in U.S. Pat. No. 2,189,996. This known bimetallic strip can be connected, on the one hand, to a voltage of 110 V and, on the other hand, to a voltage of 220 V. When connected to a voltage of 110 V, the ends of the two outer arms are electrically connected directly to one another and to one terminal of a current source. The two inner arms which are connected to one another are in electrical contact with the other terminal of the current source. When the bimetallic strip is connected to 220 V, all the arms are connected in series, the electrical connection being made at the ends of the two outer arms. Thus, the resistance is also increased in this known bimetallic strip, but merely for the purpose of being able to switch the bimetallic strip over from 110 V to 220 V.

Since in the case of the bimetallic strips being considered here normal sustained temperatures of about 90° C can occur during heating, and maximum temperatures of about 200° C can occur for brief periods under overcurrent, connecting pieces composed of thermosetting plastics are used for stabilising the bimetallic strip in accordance with the invention. For example, the thermosetting plastics can be a glass-fibre reinforced polyester resin.

The insulating material of one of the connecting pieces may be shaped as to converge in a direction pointing away from a plane of the bimetallic strip and acts on the cone of a screw for setting the tripping current. In this way, a bimetallic strip which is presettable in use to various currents is obtained. In order to simplify and improve manufacture, the connecting pieces can be moulded onto the bimetallic strip in appropriate injection moulds or compression moulds.

The present invention also relates to a thermal trip device including the bimetallic strip.

The present invention will now be described by way of example, with reference to the accompanying drawings, wherein.

Figure 2:
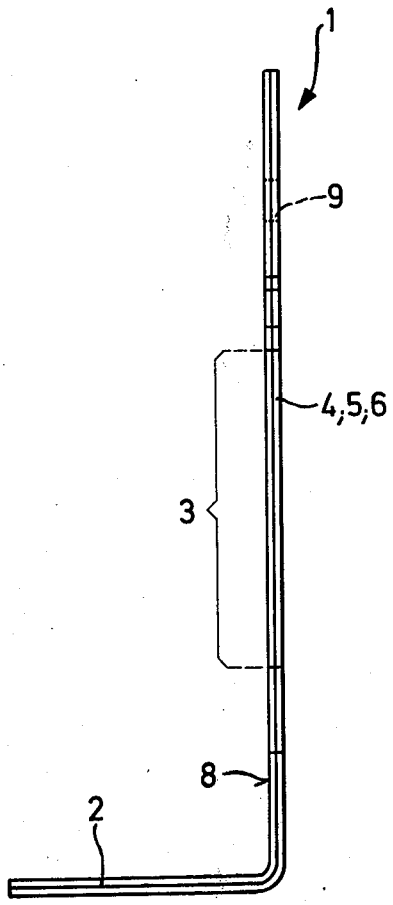
FIG. 2 shows a view along the line II—II of FIG. 1.
Figure 1:
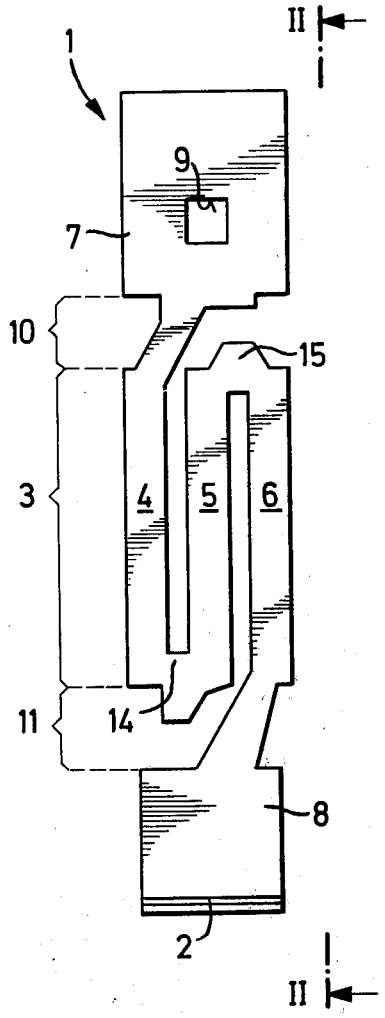
FIG. 1 shows a plan view of a bimetallic strip in accordance with the invention without the connecting pieces composed of insulating material.
Figure 4:
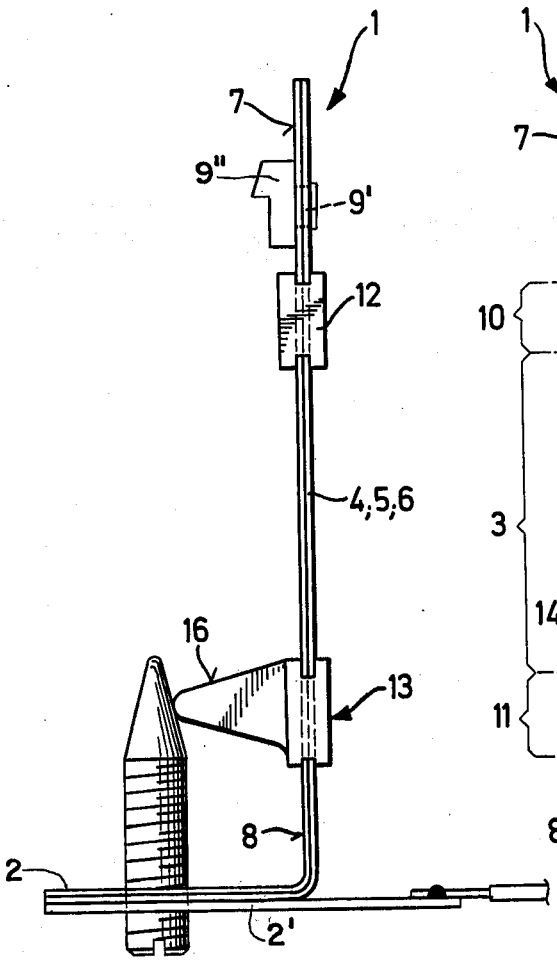
FIG. 4 shows a view along the line IV—IV of FIG. 3.
Figure 3:
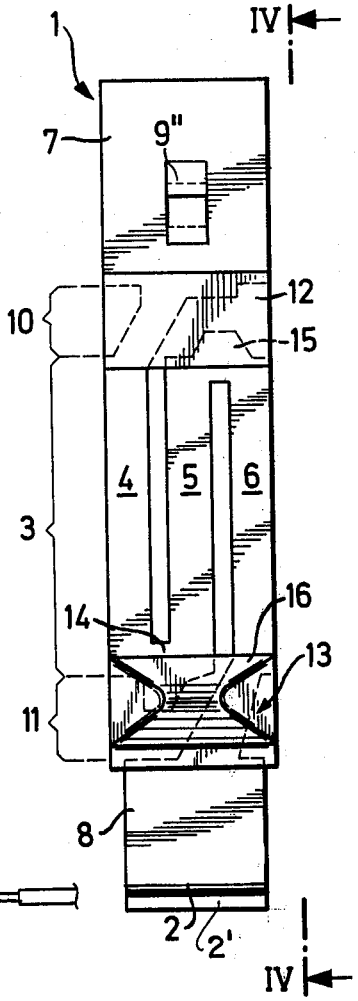
FIG. 3 shows a view similar to that of FIG. 1 with the connecting pieces composed of insulating material fitted to the strip.

In FIG. 1 to 4, an elongate bimetallic strip 1 is shown which has a right-angled bend 2, which serves for fastening to a connection lug 2′ of a thermal device. The connection lug 2′ can be welded or otherwise secured to the bend 2. The connection lug 2′ is fixed in the housing of an overcurrent circuit breaker such as that disclosed in U.S. Pat. No. 2,895,028 the disclosure of which is included herein by way of reference. A central part 3 of the bimetallic strip 1 is slit in such a way that it is divided up into three arms 4 to 6, which are parallel to one another and extend along the longitudinal direction of the bimetallic strip 1. All the arms 4 to 6 are connected in series in meanderline fashion. The two outer arms 4 and 6 are mechanically and electrically connected to end portions 7 and 8 of the bimetallic strip 1, which have no slits and thus no arms. The portion 8 merges into the bend 2 which is electrically and mechanically connected to the appropriate connection lug 2′. The end portion 7 has a square opening 9. A corresponding pin of a holding catch 9′, which pin serves as a contact piece 9′, is inserted into the opening 9 and riveted to the part 7. This contact piece 9′ and the connection lug 2′ joined to the bend 2 serve to connect the bimetallic strip 1 electrically to the parts of the terminal trip.

For the purpose of stabilising or stiffening the bimetallic strip 1, connecting pieces 12 and 13 composed of an electrical insulating material are provided. The connecting piece 12 is provided in a region 10 and rigidly connects an end 15 formed at the junction of the adjacent arms 5, 6 to the end portion 7 and the extension of the arm 4 to the portion 7. Likewise the connecting piece 13 is provided in a region 11 and rigidly connects an end 14 formed at the junction of the adjacent arms 4, 5 to the end portion 8 and the extension of the arm 6 to the portion 8. Taking into account the fact that the bimetallic strip 1 can reach high temperatures of the order of 200° C when heated directly, a thermosetting plastic, for example a glass-fibre reinforced polyester resin, is used as the insulating material for the connecting pieces 12, 13. A frusto pyramidal portion 16, of the connecting piece 13 extends away from the bimetallic strip 1 substantially normal to the plane thereof. The portion 16 is acted upon by the cone of a screw for setting the tripping current. Conveniently the connecting pieces 12, 13 can be moulded onto the bimetallic strip by injection or compression moulding.

The bimetallic strip 1 in accordance with the invention can be used in place of an indirectly heated bimetallic strip provided with a heating coil provided in known circuit breakers.

It is claimed:

1. A directly heated bimetallic strip for use in a thermal trip, said bimetallic strip having
   a. a first end portion;
   b. a second end portion;
   c. a portion intermediate said first and second end portions, said intermediate portion comprising an odd number plurality of parallel, series connected arms extending substantially longitudinally of the bimetallic strip with an end of one of the arms connected to said first end portion, an end of another of the arms connected to said second end portion and the junctions between pairs of said arms being spaced from said first and second end portions, and
   d. first and second connecting pieces of an insulating material, said first connecting piece rigidly joining together said first end portion, said one arm and each junction of said pairs of arms spaced from said one end portion, and said second connecting piece rigidly joining together said second end portion, said another arm and each junction of said pairs of arms spaced from said second end portion.

2. A bimetallic strip as claimed in claim 1, wherein the insulating material for said first and second pieces connecting is a thermosetting plastic.

3. A bimetallic strip as claimed in claim 2, wherein said thermosetting plastic is a glass fibre-reinforced polyester resin.

4. A bimetallic strip as claimed in claim 1, wherein the insulating material of said second connecting piece converges in a direction pointing away from a plane of said bimetallic strip.

5. A bimetallic strip as claimed in claim 4, wherein said second end portion includes a bent terminal portion pointing away from said plane in the same direction as said second connecting piece.

6. A bimetallic strip as claimed in claim 5, wherein said first end portion is adapted to have a contact pin of a holding catch secured thereto.

7. A bimetallic strip as claimed in claim 1, wherein said first and second connecting pieces are formed by moulding said insulating material on to the bimetallic strip.

8. A thermal trip device comprising, in combination,
   a. a holding catch;
   b. a connection lug; and
   c. a bimetallic strip disposed to form a series connection between said holding catch and said connection lug, said bimetallic strip having
      i. a first end portion,
      ii. a second end portion,
      iii. a portion intermediate said first and second end portions, said intermediate portion comprising an odd number plurality of parallel, series connected arms extending substantially longitudinally of the bimetallic strip with an end of one of the arms connected to said first end portion and an end of another of the arms connected to said second end portions with the junctions between pairs of said arms being spaced from said first and second end portions,
      iv. first and second connecting pieces of an insulating material, said first connecting piece rigidly joining together said first end portion, said one arm and each junction of said pairs of arms spaced from said one end portion, and said second connecting piece rigidly joining together said second end portion, said another arm and each junction of said pairs of arms spaced from said second end portion, and
      v. a contact piece of said holding catch secured to said first portion.

9. A thermal trip device as claimed in claim 8, further comprising an adjustable, presettable contact on said connecting lug for setting the tripping current, and wherein said insulating material of said second connecting piece is disposed to abut said presettable contact.

* * * * *